US011939988B2

(12) United States Patent
Ling et al.

(10) Patent No.: US 11,939,988 B2
(45) Date of Patent: Mar. 26, 2024

(54) AIR DUCT COMPONENT FOR CROSS-FLOW IMPELLER AND AIR CONDITIONING APPARATUS HAVING SAME

(71) Applicants: CHONGQING MIDEA AIR-CONDITIONING EQUIPMENT CO., LTD., Chongqing (CN); GD MIDEA AIR-CONDITIONING EQUIPMENT CO., LTD., Foshan (CN)

(72) Inventors: Jing Ling, Chongqing (CN); Longfei Wang, Chongqing (CN); Qiankun Liu, Chongqing (CN); Xidong Wang, Chongqing (CN)

(73) Assignees: CHONGQING MIDEA AIR-CONDITIONING EQUIPMENT CO., LTD., Chongqing (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 262 days.

(21) Appl. No.: 17/424,420

(22) PCT Filed: Nov. 16, 2020

(86) PCT No.: PCT/CN2020/129052
§ 371 (c)(1),
(2) Date: Jul. 20, 2021

(87) PCT Pub. No.: WO2022/077688
PCT Pub. Date: Apr. 21, 2022

(65) Prior Publication Data

US 2022/0372991 A1 Nov. 24, 2022

(30) Foreign Application Priority Data

Oct. 13, 2020 (CN) ..... 202011088504.5
Oct. 13, 2020 (CN) ..... 202022273245.5

(51) Int. Cl.
*F04D 17/04* (2006.01)
*F04D 25/08* (2006.01)
(Continued)

(52) U.S. Cl.
CPC ..... *F04D 29/30* (2013.01); *F04D 17/04* (2013.01); *F04D 25/08* (2013.01); *F04D 29/4233* (2013.01); *F04D 29/441* (2013.01)

(58) Field of Classification Search
CPC ..... F04D 29/4233; F04D 29/441; F04D 17/04
See application file for complete search history.

(56) References Cited

U.S. PATENT DOCUMENTS 11,396,879 B2 * 7/2022 Kashihara ..... F24F 1/00
2010/0126206 A1 * 5/2010 Park ..... F24F 1/0025 62/419

FOREIGN PATENT DOCUMENTS

CN 2676085 Y 2/2005
CN 103062874 A 4/2013
(Continued)

OTHER PUBLICATIONS

Canadian Intellectual Property Office The Office Action for CA Application No. 3057122 dated Nov. 18, 2022 4 Pages.
(Continued)

*Primary Examiner* — Sabbir Hasan
(74) *Attorney, Agent, or Firm* — Anova Law Group, PLLC

(57) ABSTRACT

An air duct component includes first and second volute members arranged oppositely in a cross section perpendicular to an axis of a cross-flow impeller. An inner end of the
(Continued)

first volute member includes a volute tongue. A cross-flow air duct formed between the first and second volute members includes a middle air duct section and an end air duct section arranged along an axial direction of the cross-flow impeller. The middle air duct section includes a middle air outlet duct located downstream of a vertical line that passes through the volute tongue and is perpendicular to the second volute member. The end air duct section includes an end air outlet duct located downstream of the vertical line. A cross-sectional area of the middle air outlet duct is larger than a cross-sectional area of the end air outlet duct.

7 Claims, 8 Drawing Sheets

(51) Int. Cl.

| | |
|---|---|
| ***F04D 29/30*** | (2006.01) |
| ***F04D 29/42*** | (2006.01) |
| ***F04D 29/44*** | (2006.01) |

(56) References Cited

FOREIGN PATENT DOCUMENTS

| | | | |
|---|---|---|---|
| CN | 104729039 | A | 6/2015 |
| CN | 105605685 | A | 5/2016 |
| CN | 108592180 | A | 9/2018 |
| CN | 208186765 | U | 12/2018 |
| CN | 209689044 | U | 11/2019 |
| JP | H05196242 | A | 8/1993 |
| JP | H08303393 | A | 11/1996 |
| JP | 2006336514 | A | 12/2006 |
| KR | 19980016950 | A | 6/1998 |

OTHER PUBLICATIONS

The European Patent Office (EPO) Extended Search Report for EP Application No. 20914785.9 dated Oct. 5, 2022 7 Pages.

World Intellectual Property Organization (WIPO) International Search Report and Written Opinion for PCT/CN2020/129052 dated Jul. 9, 2021 20 Pages (with translation).

* cited by examiner

AIR DUCT COMPONENT FOR CROSS-FLOW IMPELLER AND AIR CONDITIONING APPARATUS HAVING SAME

CROSS-REFERENCE TO RELATED APPLICATIONS

The present application is a National Stage Entry under 35 U.S.C. § 371 of International Application No. PCT/CN2020/129052, filed Nov. 16, 2020, which is based on and claims priority to Chinese Patent Application Serial Nos. 202011088504.5 and 202022273245.5, both filed on Oct. 13, 2020, the entire contents of all of which are incorporated herein by reference.

FIELD

The present application relates to the field of air ducts, and particularly to an air duct component for a cross-flow impeller and an air conditioning apparatus having the same.

BACKGROUND

For some air conditioners in the related art, cross-flow impellers are adopted to be matched with cross-flow air ducts; however, in a working process of the cross-flow impeller, air unevenly flows in a whole length range of the cross-flow air duct, resulting in airflow abnormal noise in the cross-flow air duct.

SUMMARY

The present application seeks to solve at least one of the problems existing in the related art. To this end, an objective of the present application is to provide an air duct component for a cross-flow impeller, which may improve air-output abnormal noise.

The present application further provides an air conditioning apparatus having the above air duct component.

An air duct component for a cross-flow impeller according to embodiments of the first aspect of the present application includes a first volute member and a second volute member. The first volute member and the second volute member are oppositely arranged in a cross section perpendicular to an axis of the cross-flow impeller, to form a cross-flow air duct between the first volute member and the second volute member, and in an axial direction of the cross-flow impeller, the cross-flow air duct includes a middle air duct section and two end air duct sections located at two ends of the middle air duct section. An inner end of the first volute member includes a volute tongue, and in the cross section, a vertical line is drawn towards the second volute member through the volute tongue, a part of the middle air duct section located downstream of the vertical line is a middle air outlet duct, a part of each end air duct section located downstream of the vertical line is an end air outlet duct, and a cross-sectional area S1 of the middle air outlet duct is larger than a cross-sectional area S2 of the end air outlet duct.

The air duct component for the cross-flow impeller according to the embodiments of the present application may improve the air-output abnormal noise.

In some embodiments, in the axial direction of the cross-flow impeller, the cross-flow air duct has a length of W1, the end air duct section has a length of W2, and 5 mm≤W2≤0.3W1.

In some embodiments, a part of the volute tongue corresponding to the middle air duct section is a middle volute tongue section, and a part of the volute tongue corresponding to each end air duct section is an end volute tongue section, wherein a minimum gap between the middle volute tongue section and the cross-flow impeller is T1, a minimum gap between the end volute tongue section and the cross-flow impeller is T2, and T2>T1.

In some embodiments, the cross-flow impeller has a diameter of D, 0.04D≤T≤T1≤0.06D, and 0.04D≤T2≤0.06D.

In some embodiments, the first volute member includes a first linear section, the volute tongue is connected to an inner end of the first linear section, a part of the first linear section corresponding to the middle air duct section is a first middle linear section, a part of the first linear section corresponding to each end air duct section is a first end linear section, and an outer end of the first end linear section is located on a side of an outer end of the first middle linear section close to the second volute member.

In some embodiments, in the cross section perpendicular to the axis of the cross-flow impeller, an inner end of the first end linear section coincides with an inner end of the first middle linear section, and an included angle $\alpha 1$ between the first end linear section and the first middle linear section satisfies $3° \leq \alpha 1 \leq 7°$.

In some embodiments, a part of an inner end portion of the second volute member corresponding to the middle air duct section is a middle inner end section, and a part of the inner end portion of the second volute member corresponding to each end air duct section is an end-portion inner end section, wherein a minimum gap between the middle inner end section and the cross-flow impeller is T3, a minimum gap between the end-portion inner end section and the cross-flow impeller is T4, and T4>T3.

In some embodiments, the cross-flow impeller has a diameter of D, 0.04D≤T3≤0.06D, and 0.04D≤T4≤0.06D.

In some embodiments, the second volute member includes a second linear section, apart of the second linear section corresponding to the middle air duct section is a second middle linear section, a part of the second linear section corresponding to each end air duct section is a second end linear section, and an outer end of the second end linear section is located on a side of an outer end of the second middle linear section close to the first volute member.

In some embodiments, in the cross section perpendicular to the axis of the cross-flow impeller, an inner end of the second end linear section coincides with an inner end of the second middle linear section, and an included angle $\alpha 2$ between the second end linear section and the second middle linear section satisfies $3° \alpha 2 \leq 7°$.

In some embodiments, a part of the second volute member corresponding to the middle air duct section is a second middle volute section, a part of the second volute member corresponding to each end air duct section is a second end volute section, and in the cross section perpendicular to the axis of the cross-flow impeller, the second end volute section is deflected towards the first volute member by an angle $\alpha 3$ around a central axis of the cross-flow impeller relative to the second middle volute section, wherein $3° \leq \alpha 3 \leq 7°$.

In some embodiments, a part of the first volute member corresponding to the middle air duct section is a first middle volute section, a part of the first volute member corresponding to each end air duct section is a first end volute section, a part of the second volute member corresponding to the middle air duct section is a second middle volute section, and a part of the second volute member corresponding to each end air duct section is a second end volute section, and wherein in the cross section perpendicular to the axis of the cross-flow impeller, an included angle between the first middle volute section and the second middle volute section is $\alpha 4$, an included angle between the first end volute section and the second end volute section is $\alpha 5$, and $\alpha 5<\alpha 4$.

In some embodiments, $3° \leq \alpha 5-\alpha 4 \leq 7°$.

In some embodiments, $3° \leq \alpha 4 \leq 20°$, and $3° \leq \alpha 5 \leq 20°$.

In some embodiments, in the cross section perpendicular to the axis of the cross-flow impeller, the vertical line has a length of H, the cross-flow impeller has a diameter of D, and $0.45D \leq H \leq 0.65D$.

An air conditioning apparatus according to embodiments of the second aspect of the present application includes a cross-flow impeller and the air duct component for the cross-flow impeller according to the embodiments of the first aspect of the present application, wherein the cross-flow impeller is arranged in the cross-flow air duct.

The arrangement of the above-mentioned air duct component for a cross-flow impeller according to the embodiments of the first aspect improves the air-output abnormal noise of the air conditioning apparatus according to the embodiments of the present application.

In some embodiments, the air conditioning apparatus is a mobile air conditioner and includes a heat exchanger arranged on a rear side of the cross-flow impeller, the cross-flow impeller is arranged at an entrance of the cross-flow air duct, and the second volute member is located on a front side of the first volute member, wherein the heat exchanger includes a first heat exchange member extending vertically, a horizontal distance between the axis of the cross-flow impeller and a rear surface of the first heat exchange member is L1, a maximum horizontal distance between a rear surface of the second volute member and the axis of the cross-flow impeller is L2, and the cross-flow impeller has a diameter of D, wherein $0.7D \leq L1 \leq D$, and/or $0.65D \leq L2 \leq D$.

Additional aspects and advantages of the present application will be given in part in the following descriptions, become apparent in part from the following descriptions, or be learned from the practice of the embodiments of the present application.

Figure 1:
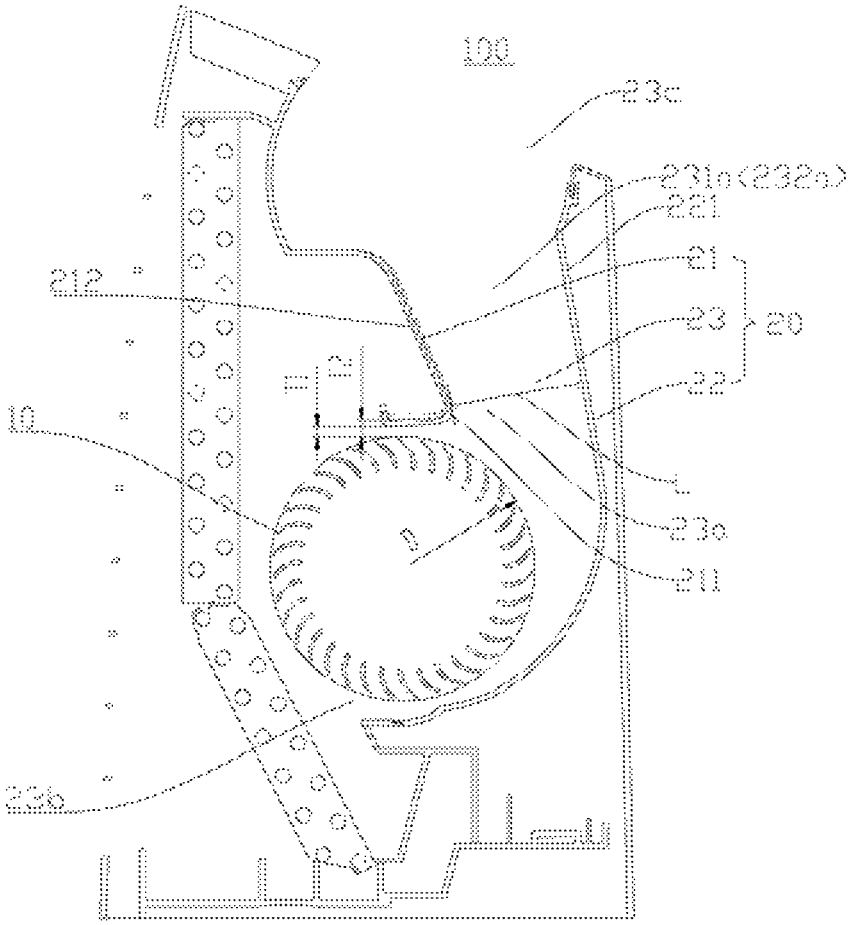
FIG. 1 is a schematic sectional view of an air conditioning apparatus according to one embodiment of the present application.

REFERENCE NUMERALS air conditioning apparatus 100;
cross-flow impeller 10;
air duct component 20;
first volute member 21; first middle volute section 21*a*; first end volute section 21*b;*
volute tongue 211; middle volute tongue section 211*a*; end volute tongue section 211*b;*
first linear section 212; first middle linear section 212*a*; first end linear section 212*b;*
second volute member 22; second middle volute section 22*a*; second end volute section 22*b;*
middle inner end section 22*a*1; end-portion inner end section 22*b*1;
second linear section 221; second middle linear section 221*a*; second end linear
section 221*b;*
cross-flow air duct 23; throat portion 23*a*; air inlet 23*b*; air outlet 23*c;*
middle air duct section 231; middle air outlet duct 231*a;*
end air duct section 232, end air outlet duct 232*a;*
heat exchanger 30: first heat exchange member 31; second heat exchange member 32.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and intended for explaining the present application. The embodiments shall not be construed to limit the present application.

The following disclosure provides many different embodiments or examples for implementing different structures of the present application. In order to simplify the disclosure of the present application, the components and arrangements of the specific examples are described below. Of course, they are merely examples and are not intended to limit the present application. In addition, the present application may be repeated with reference to the numerals and/or reference numerals in the various examples. This repetition is for the purpose of simplicity and clarity, and does not indicate the relationship between the various embodiments and/or arrangements discussed. Moreover, the present application provides examples of various specific processes and materials, but one of ordinary skill in the art will recognize the applicability of other processes and/or the use of other materials.

An air duct component 20 for a cross-flow impeller 10 according to embodiments of a first aspect of the present application will be described below with reference to the drawings.

Figure 2:
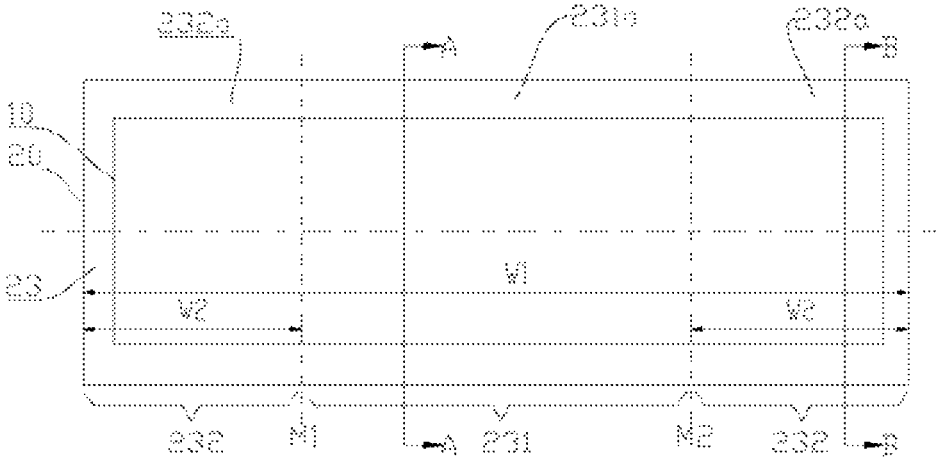
FIG. 2 is a schematic diagram in which a cross-flow impeller is fitted with an air duct component according to one embodiment of the present application.

As shown in FIG. 1, the air duct component 20 includes a first volute member 21 and a second volute member 22 which are arranged oppositely, and the first volute member 21 and the second volute member 22 are oppositely disposed in a cross section perpendicular to an axis of the cross-flow impeller 10 (for example, in the cross section shown in FIG. 1), so as to form a cross-flow air duct 23 between the first volute member 21 and the second volute member 22, and referring to FIG. 2, in an axial direction of the cross-flow impeller 10, the cross-flow air duct 23 includes a middle air duct section 231 and two end air duct sections 232 located at two ends of the middle air duct section 231 respectively.

For example, in an example shown in FIG. 2, when the axial direction of the cross-flow impeller 10 is a left-right direction, the cross-flow air duct 23 includes the middle air duct section 231 (the region between line M1 and line M2 shown in FIG. 2), the end air duct section 232 located on the left side of the middle air duct section 231 (the region on the left side of line M1 shown in FIG. 2), and the end air duct section 232 located on the right side of the middle air duct section 231 (the region on the right side of line M2 shown in FIG. 2).

As shown in FIG. 1, an inner end of the first volute member 21 includes a volute tongue 211, and it should be noted that "inner" described herein refers to the side close to an air inlet 23*b* of the cross-flow air duct 23, and "outer" refers to the side close to an air outlet 23*c* of the cross-flow impeller 10. On the above-mentioned cross section, a vertical line L is drawn through the volute tongue 211 towards the second volute member 22, and it should be noted that the above-mentioned vertical line L is the shortest one of all vertical lines drawn from all points on the volute tongue 211 to the second volute member 22, i.e., a vertical line with a minimum distance from the volute tongue 211 to the second volute member 22. Furthermore, it may be understood that the part of the cross-flow air duct 23 located at the vertical line L may be referred to as a throat portion 23*a* of the cross-flow air duct 23, and when the cross-flow impeller 10 works, airflow enters the cross-flow air duct 23 from the air inlet 23*b* thereof, and flows through the throat portion 23*a* thereof to the air outlet 23*c* thereof.

As shown in FIGS. 1 and 2, the part of the middle air duct section 231 located downstream of the vertical line L serves as a middle air outlet duct 231*a*, and the part of the end air duct section 232 located downstream of the vertical line L serves as an end air outlet duct 232*a*; that is, the airflow enters the cross-flow air duct 23 from the air inlet 23*b*, a part of the airflow enters the middle air duct section 231 of the cross-flow air duct 23, the rest of the airflow enters the end air duct section 232 of the cross-flow air duct 23, the airflow entering the middle air duct section 231 flows through the throat portion 23*a* to the middle air outlet duct 231*a*, and the airflow entering the end air duct section 232 flows through the throat portion 23*a* to the end air outlet duct 232*a*.

Figure 3:
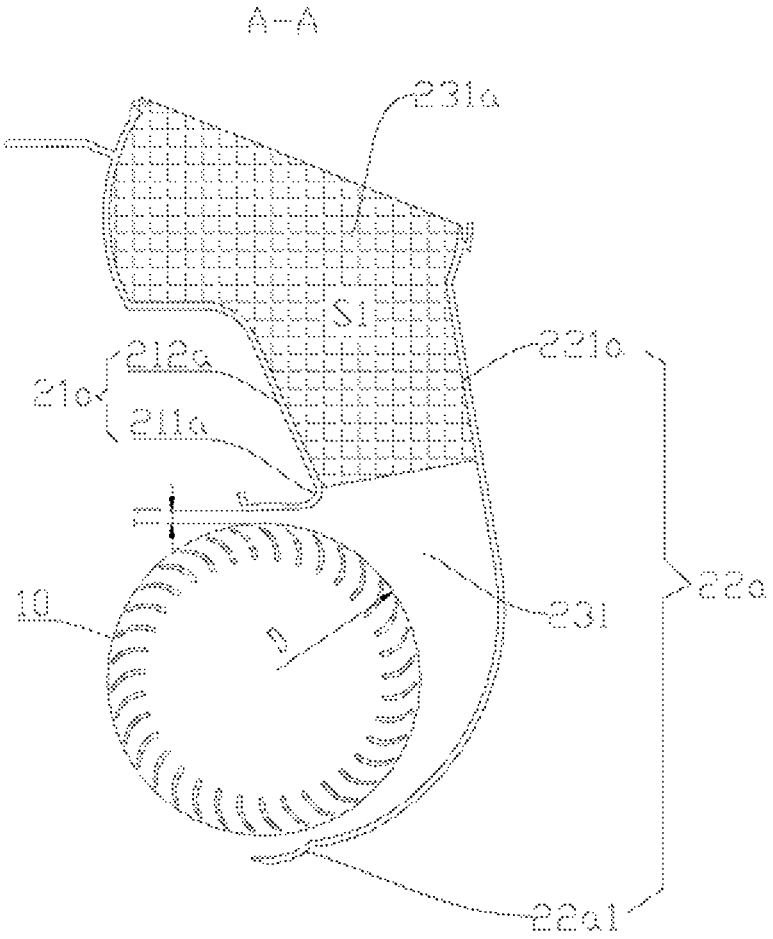
FIG. 3 is a sectional view taken along line A-A of FIG. 2.
Figure 4:
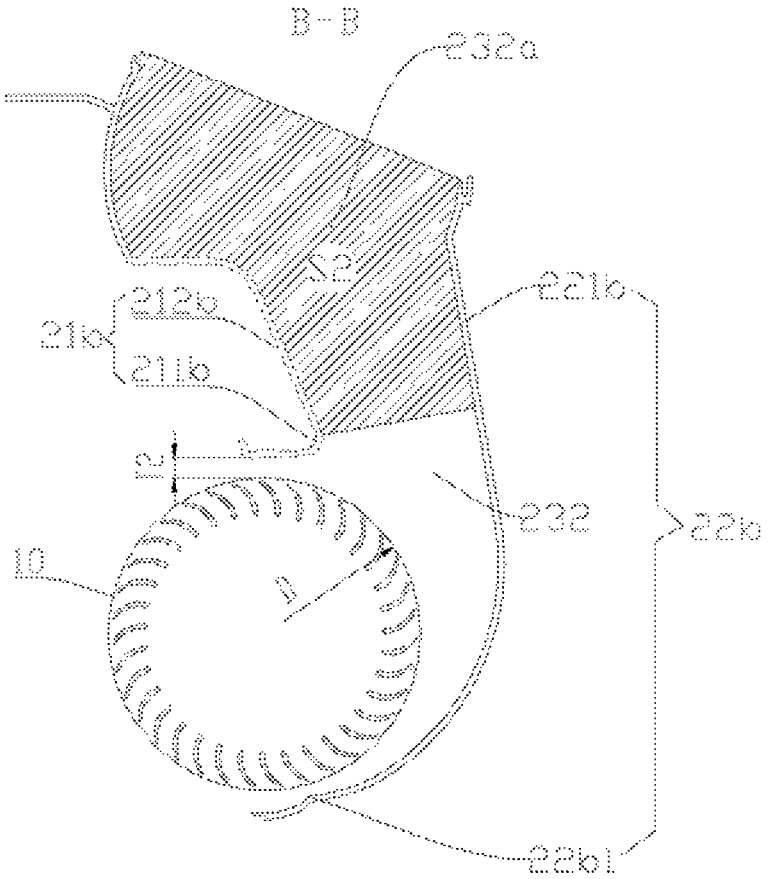
FIG. 4 is a sectional view taken along line B-B of FIG. 2.

As shown in FIGS. 2 to 4, the middle air outlet duct 231*a* has a cross-sectional area S1, the end air outlet duct 232*a* has a cross-sectional area S2, and S2<S1. For example, referring to FIG. 1, the middle air duct section 231 is formed between the first volute member 21, which is entirely represented by a solid line section, and the second volute member 22; correspondingly, in FIG. 3, the shaded region in FIG. 3 is the cross-sectional area of the middle air outlet duct 231*a*. In FIG. 1, the end air duct section 232 is formed between the first volute member 21 having a dotted line section and the second volute member 22; correspondingly in FIG. 4, the shaded region in FIG. 4 is the cross-sectional area of the end air outlet duct 232*a*. Since the first volute member 21 having the dotted line section in FIG. 1 is located on the side of the first volute member 21 entirely represented by the solid line section close to the second volute member 22, it is apparent that S2<S1.

Thus, in the air duct component 20 according to the embodiments of the present application, the cross-sectional area S2 of the end air outlet duct 232*a* is set to be smaller than the cross-sectional area S1 of the middle air outlet duct 231*a*, such that a larger air outlet area exists in the middle in a length direction of the cross-flow air duct 23 (i.e., an axial direction of the cross-flow impeller 10), and may be matched with a higher air outlet speed, and smaller air outlet areas exist at two end portions and may be matched with lower air outlet speeds, such that airflow loads which are substantially the same exist in a whole length range of the cross-flow air duct 23, and the airflow is uniform, thus effectively improving air-supply abnormal noise generated at the two end portions of the cross-flow air duct 23.

In some air conditioners in the related art, cross-flow impellers are adopted to be matched with cross-flow air ducts; however, in a working process of the cross-flow impeller, air unevenly flows in the whole length range of the cross-flow air duct, resulting in airflow abnormal noise in the cross-flow air duct. Regarding the root causes, the inventors found that the cross-flow impeller has a smaller length than the cross-flow air duct, and under influences of two side wall surfaces of the cross-flow air duct, the higher airspeed exists in the middle in the length direction of the cross-flow air duct (i.e., the axial direction of the cross-flow impeller), and the lower air speed exists near the two side wall surfaces.

However, since a volute tongue and a volute of the cross-flow air duct in the related art have the same cross sections at different length positions, all positions of the cross-flow air duct have coincident projection curves in a cross section perpendicular to an axis of the cross-flow impeller, and the cross-flow air duct has the same air outlet area in a whole length direction, such that airflow loads are different in the whole length range of the cross-flow air duct, the air flows unevenly, and airflow on two sides is not matched with an air duct load, thereby generating discontinuous airflow sounds on the two sides of the cross-flow air duct and resulting in the airflow abnormal noise.

In the air duct component 20 according to the embodiments of the present application, by setting the cross-sectional area S2 of the end air outlet duct 232*a* to be smaller than the cross-sectional area S1 of the middle air outlet duct 231*a*, the cross-flow air duct 23 has different air outlet sections in the whole length range and has a variable section design, such that the middle air outlet duct 231*a* with the larger cross-sectional area may be adapted to the higher air outlet speed, and the end air outlet duct 232*a* with the smaller cross-sectional area may be adapted to the lower air outlet speed; or, the cross-flow air duct 23 is set to have a variable section structure, such that the middle air outlet duct 231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23 and improving the airflow abnormal noise.

It should be noted that, in the embodiments of the present application, in order to achieve the goal that "the cross-sectional area S2 of the end air outlet duct 232*a* is smaller than the cross-sectional area S1 of the middle air outlet duct 231*a*, such that the cross-flow air duct 23 has different air outlet sections in the whole length range and has a variable section design," following specific solutions are proposed in the present application, for example: the first volute member 21 and/or the second volute member 22 are/is provided to have a variable section design along the axial direction of the cross-flow impeller 10; that is, the first volute member 21 and/or the second volute member 22 may be provided to have different sectional shapes in the middle and two ends in the axial direction of the cross-flow impeller 10, thereby adapting to load changes at different positions, and effectively eliminating the air-supply abnormal noise on the two sides of the cross-flow air duct 23.

More specifically, by providing the first volute member 21 and/or the second volute member 22 to have the variable section design along the axial direction of the cross-flow impeller 10, influences of end walls of the two sides of the cross-flow air duct 23 on an air volume may be adapted, such that the air more uniformly flows in the whole length direction (i.e., the axial direction of the cross-flow impeller 10) of the whole cross-flow air duct 23, thus adapting to the characteristics of the cross-flow air duct 23 that the middle air speed is higher and the air speeds on the two sides are lower, and improving the noise generated by the nonuniform airflow on the two sides of the cross-flow air duct 23. Furthermore, it should be noted that transition may be performed by a smooth curved surface or a stepped surface at section varying positions of the first volute member 21 and the second volute member 22, which will not be limited herein.

In some embodiments of the present application, as shown in FIG. 2, in the axial direction of the cross-flow impeller 10, the cross-flow air duct 23 has a length W1, the end air duct section 232 has a length W2, and 5 mm≤5W2≤0.3W1. That is, the length W2 of the end air duct section 232 is less than or equal to 0.3 times the axial length of the cross-flow air duct 23, and greater than or equal to 5 mm, thus preventing the outlet air of the middle air duct section 231 from being greatly influenced by the length of the end air duct section 232, and avoiding the problem that an improvement effect on the abnormal noise on the two sides is not obvious due to the small length of the end air duct section 232.

However, the present application is not limited thereto, and the length W2 of the end air duct section 232 may also be adjusted according to actual situations, which is not repeated herein. Furthermore, it should be noted that the length of each end air duct section 232 is only required to meet the value, but the lengths of the two end air duct sections 232 are not required to be consistent, and may be equal or unequal.

In some embodiments of the present application, as shown in FIGS. 1, 3 and 4, the part of the volute tongue 211 corresponding to the middle air duct section 231 serves as a middle volute tongue section 211*a*, the part of the volute tongue 211 corresponding to the end air duct section 232 serves as an end volute tongue section 211*b*, the middle volute tongue section 211*a* and the cross-flow impeller 10 have a minimum gap T1, the end volute tongue section 211*b* and the cross-flow impeller 10 have a minimum gap T2, and T2>T. It may be understood that the inner end of the first volute member 21 is configured as the volute tongue 211, and the air inlet 23*b* of the cross-flow air duct 23 is formed between the volute tongue 211 and the inner end of the second volute member 22.

Thus, the volute tongue 211 is provided to have a variable section structure with a small gap between a middle part and the cross-flow impeller 10 and large gaps between two end parts and the cross-flow impeller 10, thus effectively adapting to the characteristics of small air volumes on the two sides and a large air volume in the middle of the cross-flow air duct 23, improving air volume uniformity of the cross-flow air duct 23 in the whole length direction to a certain extent (that is, the air volume is small due to airflow loss on the two sides of the cross-flow air duct 23, and air inlet resistance on the two sides may be reduced by increasing the air inlet gaps on the two sides, thereby increasing the air inlet volumes on the two sides), and reducing the noise of the air duct component 20 to a certain extent. It may be understood that, in the present embodiment, in the axial direction of the cross-flow impeller 10, the first volute member 21 is of a variable section design, and minimum distances from the volute tongue 211 to the cross-flow impeller 10, minimum distance positions, as well as angles and shapes of the volute tongue 211 may be different at the two ends and in the middle.

In some embodiments of the present application, as shown FIG. 1, the cross-flow impeller 10 has a diameter D, 0.04D≤T2≤0.06D, and 0.04D≤T1≤0.06D. Thus, although the minimum distance from the volute tongue 211 to the cross-flow impeller 10 is variable, that is, different at the two ends and in the middle, but between 0.04D and 0.06D, for example, the gap may be 0.04D, 0.045D, 0.05D, 0.055D, 0.06D, or the like, thereby guaranteeing a better performance of the cross-flow air duct 23.

As shown in FIG. 1, the first volute member 21 includes a first linear section 212, the volute tongue 211 is connected to an inner end of the first linear section 212, and with reference to FIGS. 3 and 4, the part of the first linear section 212 corresponding to the middle air duct section 231 serves as a first middle linear section 212*a*, and the part of the first linear section 212 corresponding to the end air duct section 232 serves as a first end linear section 212*b*. In some embodiments of the present application, referring to FIG. 5, an outer end of the first end linear section 212*b* is located on the side of an outer end of the first middle linear section 212*a* close to the second volute member 22.

Thus, the cross-sectional area S2 of the end air outlet duct 232*a* may be simply and effectively guaranteed to be set to be smaller than the cross-sectional area S1 of the middle air outlet duct 231*a*, such that the middle air outlet duct 231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23 and improving the airflow abnormal noise.

Figure 5:
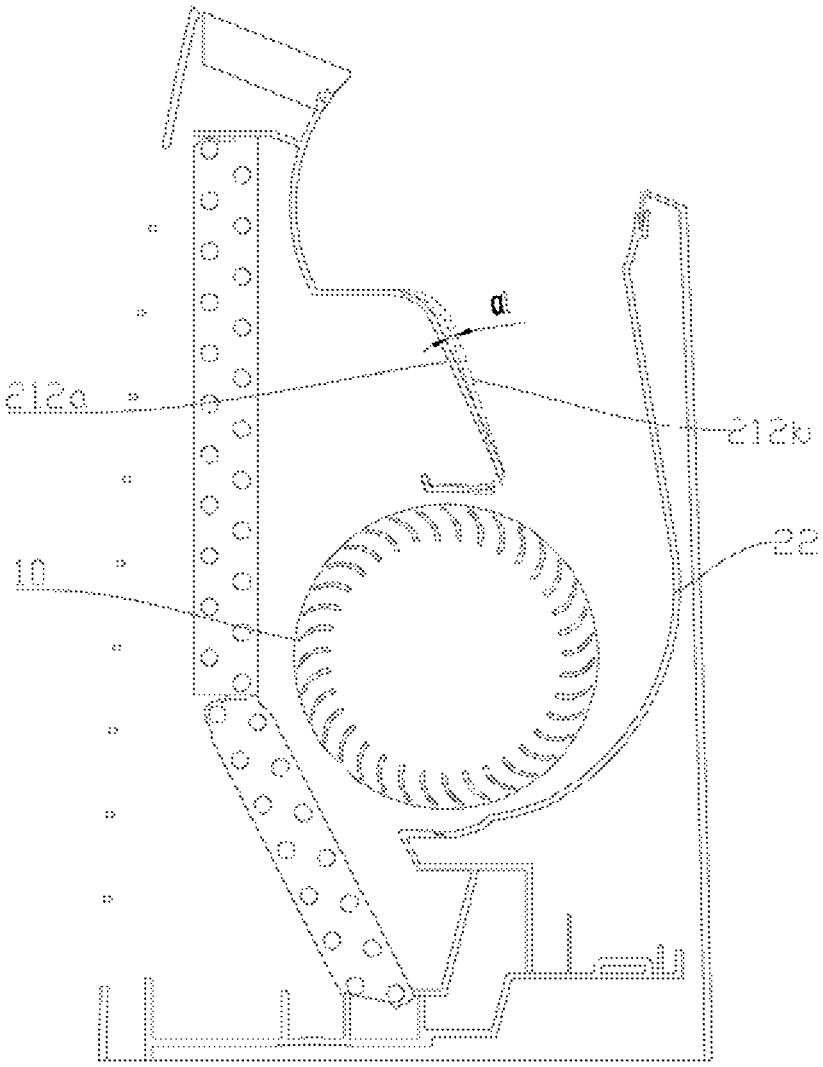
FIG. 5 is a schematic sectional view of an air conditioning apparatus according to another embodiment of the present application.

In some embodiments of the present application, as shown in FIG. 5, in the cross section perpendicular to the axis of the cross-flow impeller 10, an inner end of the first end linear section 212*b* coincides with an inner end of the first middle linear section 212*a*, the first end linear section 212*b* and the first middle linear section 212*a* have an included angle α1, and 3°≤α1≤7°, for example, α1 may be 3°, 4°, 5°, 6°, 7', or the like. That is, when the first middle linear section 212*a* is rotated by α1 towards the second volute member 22 with the inner end as a center of rotation, the first end linear section 212*b* may be obtained. It may be appreciated that in FIG. 5, the dotted line part of the first linear section 212 represents the first end linear section 212*b*, and the solid line part of the first linear section 212 represents the first middle linear section 212*a*.

Thus, a difference angle of 3° to 7° is formed between the first end linear section 212*b* and the first middle linear section 212*a*, such that the cross-sectional area S2 of the end air outlet duct 232*a* may be simply and effectively guaranteed to be set to be smaller than the cross-sectional area S1 of the middle air outlet duct 231*a*, the middle air outlet duct

231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23, improving the airflow abnormal noise, and avoiding the problem that normal air discharge on the two sides is influenced by the overlarge difference angle between the first end linear section 212*b* and the first middle linear section 212*a*.

Figure 6:
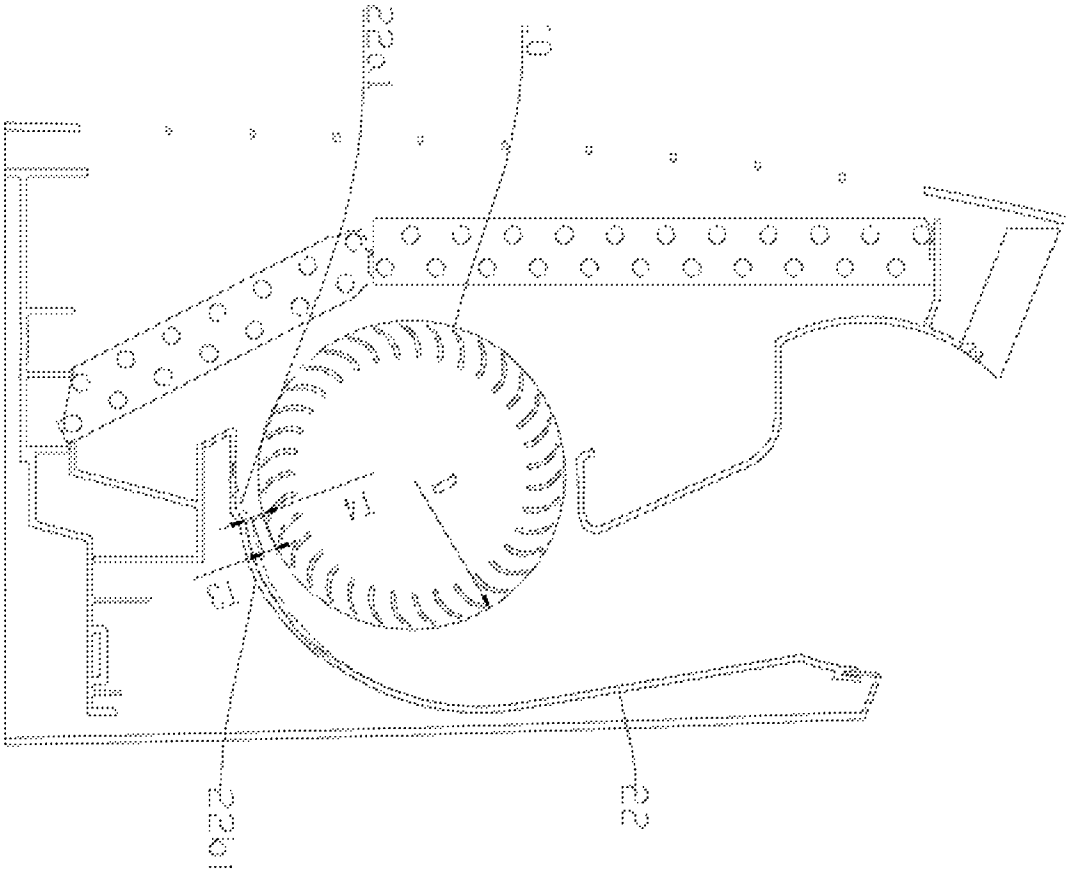
FIG. 6 is a schematic sectional view of an air conditioning apparatus according to another embodiment of the present application.

In some embodiments of the present application, as shown in FIG. 6, the part of an inner end portion of the second volute member 22 corresponding to the middle air duct section 231 serves as a middle inner end section 22*al*, the part of the inner end portion of the second volute member 22 corresponding to the end air duct section 232 serves as an end-portion inner end section 22*b*1, the middle inner end section 22*a*1 and the cross-flow impeller 10 have a minimum gap T3, the end-portion inner end section 22*b*1 and the cross-flow impeller 10 have a minimum gap 'T'4, and T4>T3. It may be appreciated that in FIG. 6, the dotted line represents the middle inner end section 22*a*1, and the solid line represents the end-portion inner end section 22*bl*.

Thus, the inner end of the second volute member 22 is provided to have a variable section structure with a small gap between a middle part and the cross-flow impeller 10 and large gaps between two end parts and the cross-flow impeller 10, thus effectively adapting to the characteristics of the small air volumes on the two sides and the large air volume in the middle of the cross-flow air duct 23, improving the air volume uniformity of the cross-flow air duct 23 in the whole length direction to a certain extent (that is, the air volume is small due to the airflow loss on the two sides of the cross-flow air duct 23, and the air inlet resistance on the two sides may be reduced by increasing the air inlet gaps on the two sides, thereby increasing the air inlet volumes on the two sides), and reducing the noise of the air duct component 20 to a certain extent. It may be understood that, in the present embodiment, in the axial direction of the cross-flow impeller 10, the second volute member 22 is of a variable section design, and minimum distances from the inner end of the second volute member 22 to the cross-flow impeller 10, minimum distance positions, as well as angles and shapes of the second volute member 22 may be different at the two ends and in the middle.

In some embodiments of the present application, as shown FIG. 6, the cross-flow impeller 10 has a diameter D. $0.04D \leq T3 \leq 0.06D$, and $0.04D \leq T4 \leq 0.06D$. Thus, although the minimum distance from the inner end of the second volute member 22 to the cross-flow impeller 10 is variable, that is, different at the two ends and in the middle, but between 0.04D and 0.06D, for example, the gap may be 0.04D, 0.045D, 0.05D, 0.055D, 0.06D, or the like, thereby guaranteeing the better performance of the cross-flow air duct 23.

Figure 7:
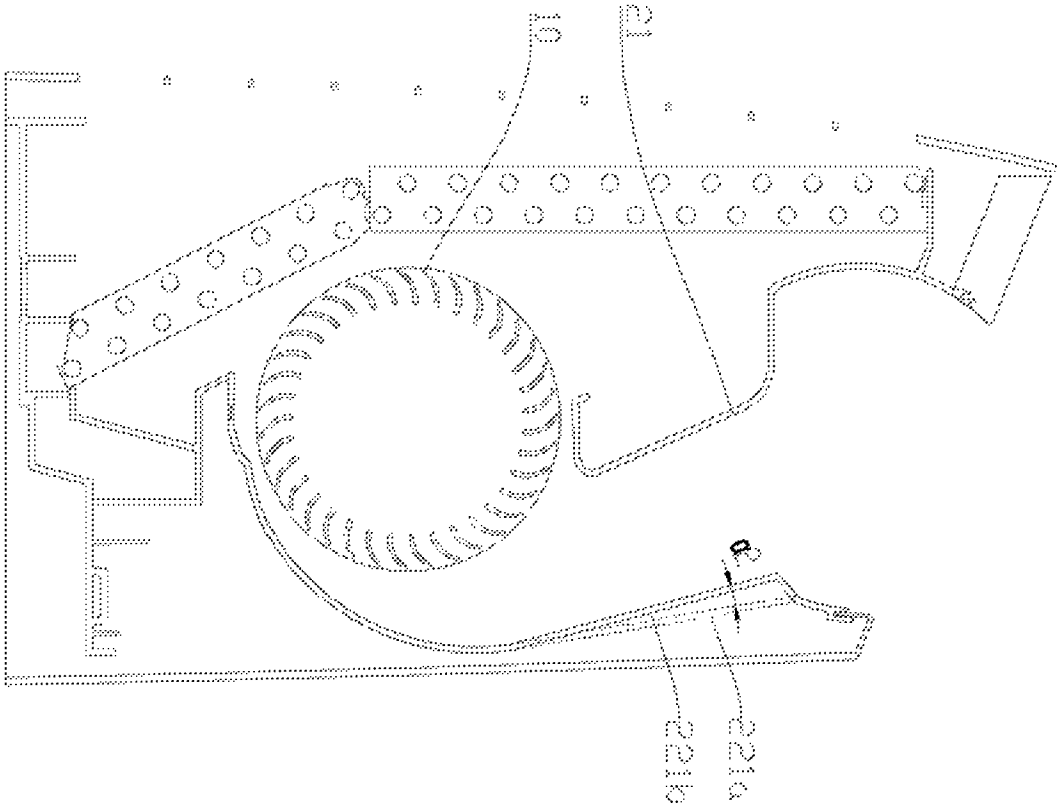
FIG. 7 is a schematic sectional view of an air conditioning apparatus according to another embodiment of the present application.

In some embodiments of the present application, as shown in FIG. 7, the second volute member 22 includes a second linear section 221, the part of the second linear section 221 corresponding to the middle air duct section 231 serves as a second middle linear section 221*a*, the part of the second linear section 221 corresponding to the end air duct section 232 serves as a second end linear section 221*b*, and an outer end of the second end linear section 221*b* is located on the side of an outer end of the second middle linear section 221*a* close to the first volute member 21. Thus, the cross-sectional area S2 of the end air outlet duct 232*a* may be simply and effectively guaranteed to be set to be smaller than the cross-sectional area S1 of the middle air outlet duct 231*a*, such that the middle air outlet duct 231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23 and improving the airflow abnormal noise.

In some embodiments of the present application, as shown in FIG. 7, in the cross section perpendicular to the axis of the cross-flow impeller 10, an inner end of the second end linear section 221*b* coincides with an inner end of the second middle linear section 221*a*, the second end linear section 221*b* and the second middle linear section 221*a* have an included angle $\alpha 2$, and $3° \leq \alpha 2 \leq 7°$, for example, $\alpha 2$ may be 3°, 4°, 5°, 6°, 7°, or the like. That is, when the second middle linear section 221*a* is rotated by $\alpha 2$ towards the first volute member 21 with the inner end as a center of rotation, the second end linear section 221*b* may be obtained. It may be understood that in FIG. 7, the solid line represents the second end linear section 221*b*, and the dotted line represents the second middle linear section 221*a*.

Thus, a difference angle of 3° to 7° is formed between the second end linear section 221*b* and the second middle linear section 221*a*, such that the cross-sectional area S2 of the end air outlet duct 232*a* may be simply and effectively guaranteed to be set to be smaller than the cross-sectional area S1 of the middle air outlet duct 231*a*, the middle air outlet duct 231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23, improving the airflow abnormal noise, and avoiding the problem that the normal air discharge on the two sides is influenced by the overlarge difference angle between the second end linear section 221*b* and the second middle linear section 221*a*.

Figure 8:
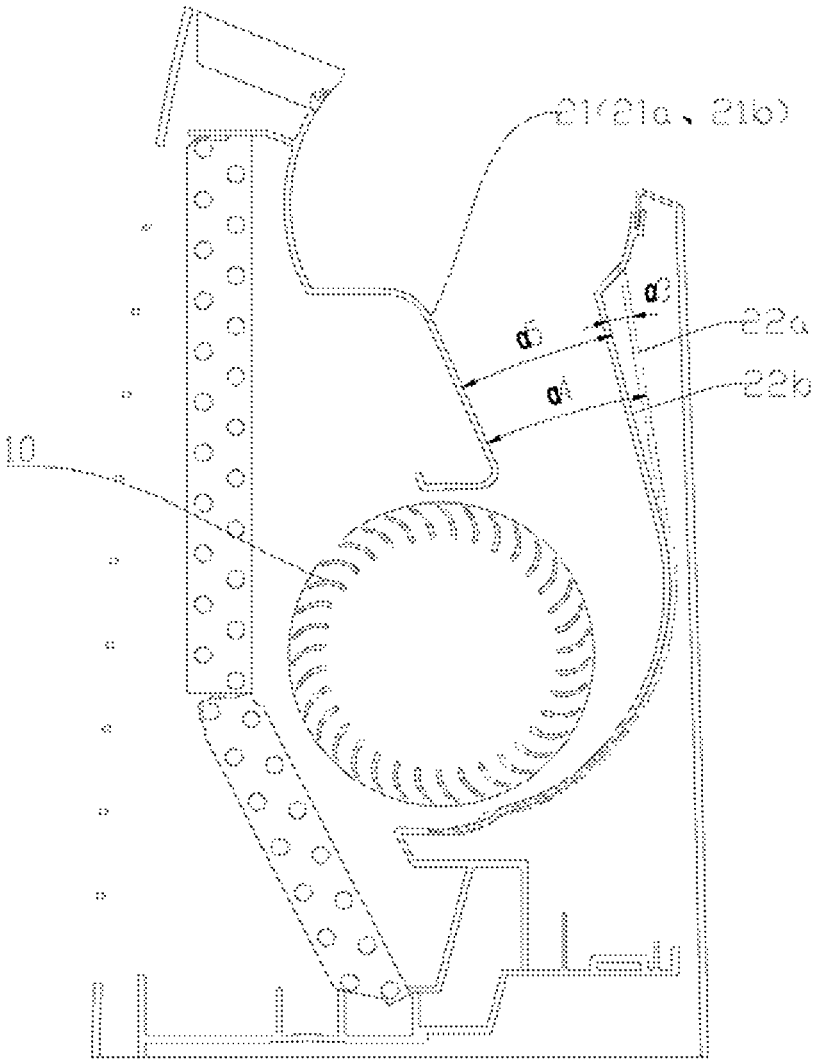
FIG. 8 is a schematic sectional view of an air conditioning apparatus according to another embodiment of the present application.

In some embodiments of the present application, as shown in FIG. 8, the part of the second volute member 22 corresponding to the middle air duct section 231 serves as a second middle volute section 22*a*, the part of the second volute member 22 corresponding to the end air duct section 232 serves as a second end volute section 22*b*, and in the cross section perpendicular to the axis of the cross-flow impeller 10, the second end volute section 22*b* is deflected by an angle $\alpha 3$ around a central axis of the cross-flow impeller 10 relative to the second middle volute section 22*a* towards the first volute member 21, and $3° \leq \alpha 3 \leq 7°$, for example, $\alpha 3$ may be 3°, 4°, 5°, 6°, 7°, or the like. That is, when the second middle volute section 22*a* is rotated by $\alpha 3$ towards the first volute member 21 with the axis of the cross-flow impeller 10 as a center of rotation, the second end volute section 22*b* may be obtained. It may be understood that in FIG. 8, the solid line represents the second end volute section 221*b*, and the dotted line represents the second middle volute section 22*a*.

Thus, a difference angle of 3 to 7° around the axis of the cross-flow impeller 10 is formed between the second end volute section 22*b* and the second middle volute section 22*a*, such that the cross-sectional area S2 of the end air outlet duct 232*a* may be simply and effectively guaranteed to be set to be smaller than the cross-sectional area S1 of the middle air outlet duct 231*a*, the middle air outlet duct 231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23, improving the airflow abnormal noise, and avoiding the problem that the normal air discharge on the two sides is influenced by the overlarge difference angle between the second end volute section 22*b* and the second middle volute section 22*a*.

In some embodiments of the present application, as shown in FIG. 3, the part of the first volute member 21 corresponding to the middle air duct section 231 serves as a first middle volute section 21*a*, and the part of the second volute member 22 corresponding to the middle air duct section 231 serves as a second middle volute section 22*a*; as shown in FIG. 4, the part of the first volute member 21 corresponding to the end air duct section 232 serves as a first end volute section 21*b*, and the part of the second volute member 22 corresponding to the end air duct section 232 serves as a second end volute section 22*b*; and in the cross section perpendicular to the axis of the cross-flow impeller 10, referring to FIG. 8, the first middle volute section 21*a* and the second middle volute section 22*a* have an included angle $\alpha 4$, the first end volute section 21*b* and the second end volute section 22*b* have an included angle $\alpha 5$, and $\alpha 5 \leq \alpha 4$.

It may be understood that, with reference to FIGS. 3 and 4, the first middle volute section 21*a* includes a first middle linear section 212*a*, the first end volute section 21*b* includes a first end linear section 212*b*, the second middle volute section 22*a* includes a second middle linear section 221*a*, the second end volute section 22*b* includes a second end linear section 221*b*, the included angle $\alpha 4$ between the first middle volute section 21*a* and the second middle volute section 22*a* is an included angle between the first middle linear section 212*a* and the second middle linear section 221*a*, and the included angle $\alpha 5$ between the first end volute section 21*b* and the second end volute section 22*b* is an included angle between the first end linear section 212*b* and the second end linear section 221*b*.

Thus, the cross-sectional area S2 of the end air outlet duct 232*a* may be simply and effectively guaranteed to be set to be smaller than the cross-sectional area S1 of the middle air outlet duct 231*a*, such that the middle air outlet duct 231*a* with the larger cross-sectional area is matched in the middle with the higher air speed, and the end air outlet ducts 232*a* with the smaller cross-sectional areas are matched on the two sides with the lower air speeds, so as to ensure that the airflow loads are substantially the same in the whole length range of the cross-flow air duct 23, and the airflow is uniform, thereby reducing the discontinuous airflow sounds generated on the two sides of the cross-flow air duct 23 and improving the airflow abnormal noise.

In some embodiments, $3° \leq \alpha 5 - \alpha 4 \leq 7°$; that is, included angles between the first volute member 21 and the second volute member 22 have a difference value of 3° to 7° at the two ends and in the middle, for example, the difference value may be 3°, 4°, 5°, 6°, 7°, thereby reducing discontinuous airflow sounds generated on the two sides of the cross-flow air duct 23, improving the airflow abnormal noise, and avoiding the problem that the normal air discharge on the two sides is influenced by the overlarge difference value.

In some embodiments of the present application, as shown in FIG. 8, $3° \leq \alpha 4 \leq 20°$, $3° \leq \alpha 5 \leq 20°$, for example, both $\alpha 4$ and $\alpha 5$ may be 3°, 6°, 9°, 12°, 15°, 20°, or the like. Thus, the included angles between the first volute member 21 and the second volute member 22 are different at the two ends and in the middle, but between 3° and 20°, thereby guaranteeing the better performance of the cross-flow air duct 23.

Figure 9:
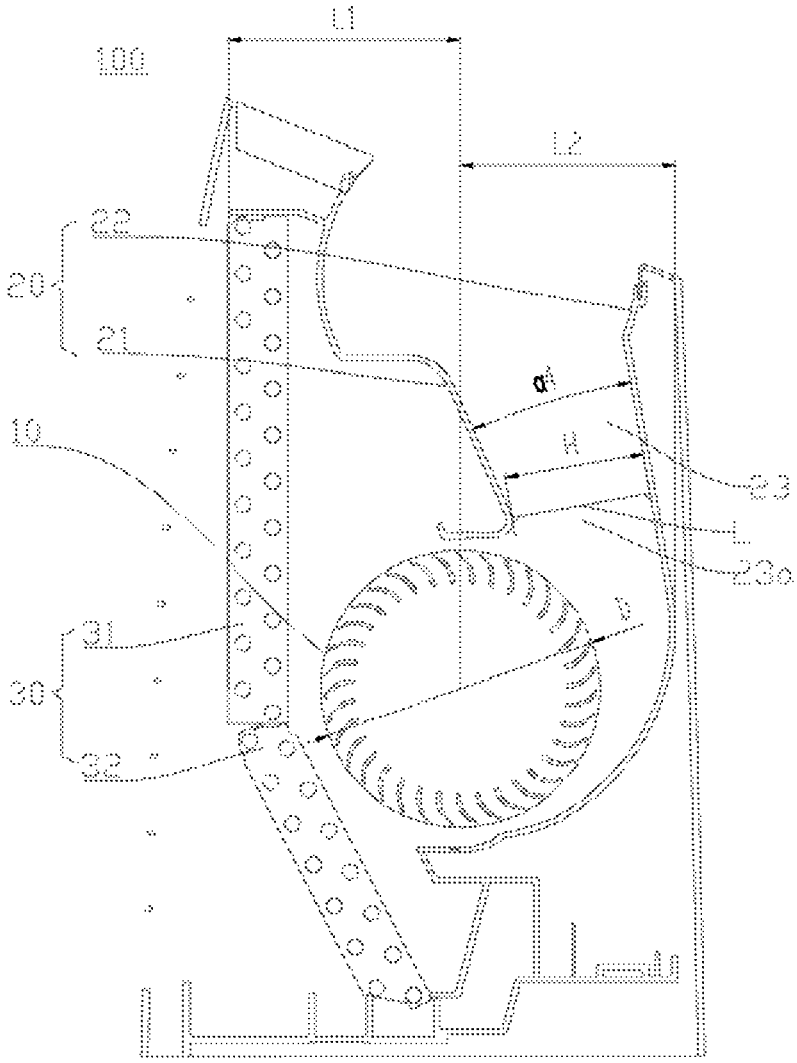
FIG. 9 is a schematic sectional view of an air conditioning apparatus according to another embodiment of the present application.

In some embodiments of the present application, as shown in FIG. 9, in the cross section perpendicular to the axis of the cross-flow impeller 10, the above-mentioned vertical line L has a length H; that is, the size from the first volute member 21 to the second volute member 22 at the throat portion 23*a* of the cross-flow air duct 23 is H, or the minimum size from the first volute member 21 to the second volute member 22 is H, the cross-flow impeller 10 has a diameter D, and $0.45D \leq H \leq 0.65D$, thus avoiding a small air volume caused by too small H, and the abnormal noise caused by too large H.

An air conditioning apparatus 100 according to embodiments of a second aspect of the present application will be described below with reference to the drawings.

As shown in FIG. 9, the air conditioning apparatus 100 according to the embodiments of the present application may include a cross-flow impeller 10 and the air duct component 20 for a cross-flow impeller 10 according to any embodiment of the first aspect of the present application, wherein the cross-flow impeller 10 is provided at the cross-flow air duct 23. For example, in some embodiments, the cross-flow impeller 10 may be provided at the air inlet 23*b* of the cross-flow air duct 23.

Thus, in the air conditioning apparatus 100 according to the embodiments of the present application, the cross-sectional area S2 of the end air outlet duct 232*a* is set to be smaller than the cross-sectional area S1 of the middle air outlet duct 231*aa*, such that the larger air outlet area exists in the middle in the length direction of the cross-flow air duct 23 (i.e., the axial direction of the cross-flow impeller 10), and may be matched with the higher air outlet speed, and the smaller air outlet areas exist at the two end portions and may be matched with the lower air outlet speeds, such that the airflow loads which are substantially the same exist in the whole length range of the cross-flow air duct 23, and the airflow is uniform, thus effectively improving the air-supply abnormal noise generated at the two end portions of the cross-flow air duct 23.

It should be noted that there is no limitation in the specific type of the air conditioning apparatus 100 according to the embodiments of the present application. For example, the air conditioning apparatus 100 may be configured as an air conditioner or an air sterilizer, or the like, and when configured as an air conditioner, the air conditioning apparatus 100 may further include a heat exchanger 30 which may be provided upstream and/or downstream of the air duct component 20, such that the air conditioner may adjust an air temperature. When configured as an air sterilizer, the air conditioning apparatus 100 may further include a sterilizing device which may be provided upstream and/or downstream of the air duct component 20, such that the air sterilizer may sterilize and disinfect air.

In addition, it should be noted that when the air conditioning apparatus 100 is configured as an air conditioner, there is no limitation in the specific type of the air conditioner, and the air conditioner may be configured as an air conditioner indoor unit (including a cabinet air conditioner indoor unit or a wall mount air conditioner indoor unit, or the like) in a split air conditioner, or a mobile air conditioner or a window air conditioner, or the like, in an all-in-one air conditioner. After the specific type of the air conditioning apparatus 100 is determined, other configurations and operations of the air conditioning apparatus 100 according to the embodiments of the present application are known to those skilled in the art and will not be described in detail herein.

For example, in some embodiments of the present application, as shown in FIG. 9, the air conditioning apparatus 100 is configured as a mobile air conditioner and includes the heat exchanger 30, the heat exchanger 30 is provided on a rear side of the cross-flow impeller 10, the cross-flow impeller 10 is provided at an entrance of the cross-flow air duct 23, and the second volute member 22 is located on a front side of the first volute member 21; the heat exchanger 30 includes a first heat exchange member 31 extending vertically, the axis of the cross-flow impeller 10 and a rear surface of the first heat exchange member 31 have a horizontal distance L1, and a rear surface of the second volute member 22 and the axis of the cross-flow impeller 10 have a maximum horizontal distance L2; that is, the horizontal distance from an outer edge of the heat exchanger 30 to a center of the cross-flow impeller 10 is L1, the maximum horizontal distance from the inner surface of the second volute member 22 to the center of the cross-flow impeller 10 is L2, and the diameter of the cross-flow impeller 10 is D.

In some embodiments, $0.7D \leq L1 \leq D$, thus avoiding the abnormal noise due to a high speed of the air passing through the heat exchanger 30 caused by too small L1, and the large size and cost caused by too large L1. In some embodiments, $0.65D \leq L2 \leq D$, thus avoiding the abnormal noise caused by too small L2, and the large complete-machine size and cost caused by too large L2.

In order to meet cost and appearance requirements, a mobile air conditioner in the related art usually has a very small and compact space size, such that a distance from a heat exchanger to a cross-flow impeller is small, airflow passing through a heat exchanger has a high speed, whining noise is generated, and performance advantages of a cross-flow air duct are unable to be developed to the maximum extent.

The mobile air conditioner according to the above-mentioned embodiments of the present application has the cross-flow air duct 23 with the rear air inlet and the front upper air outlet, and through reasonable design of the cross-flow air duct 23, the heat exchanger 30 and the cross-flow impeller 10, for example, D=126 mm, L1=104.7 mm, L2=97 mm, H=63 mm, and the first middle volute section 21*a* and the second middle volute section 22*a* have the included angle $\alpha 4=14.16°$, such that the performance of the cross-flow air duct 23 may be improved greatly, and the duct abnormal noise may be improved, for example, 2 db to 2.5 db of noise may be reduced at substantially the same air volume as compared with a conventional cross-flow air duct.

Furthermore, in some embodiments of the present application, as shown in FIG. 9, the heat exchanger 30 may further include, in addition to the first heat exchange member 31 which is provided vertically, a second heat exchange member 32 which is located below the first heat exchange member 31 and is provided obliquely, thus enhancing a heat exchanging effect, and certainly, the heat exchanger 30 may also be in other forms, which are not repeated herein.

In the description of the present application, it is to be understood that terms such as "lower," "front," "left," "right" and "axial" should be construed to refer to the orientation as shown in the drawings. These relative terms are for convenience of description and do not require that the present application be constructed or operated in a particular orientation, thus cannot be construed to limit the present application.

In addition, the terms such as "first" and "second" are used herein for purposes of description and are not intended to indicate or imply relative importance or significance or to imply the number of indicated technical features. Thus, the feature associated with "first" and "second" may include one or more of this feature explicitly or implicitly. In the description of the present application, "a plurality of" means two or more unless otherwise specified.

In the present application, unless specified or limited otherwise, a structure in which a first feature is "on" or "below" a second feature may include an embodiment in which the first feature is in direct contact with the second feature, and may also include an embodiment in which the first feature and the second feature are contacted via an additional feature formed therebetween. Furthermore, a first feature "on," "above," or "on top of" a second feature may include an embodiment in which the first feature is right or obliquely "on," "above," or"on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the description of the present specification, reference throughout this specification to "an embodiment," "some embodiments," "example," "specific example" or "some examples" means that a particular feature, structure, material, or characteristic described in connection with the embodiment or example is included in at least one embodiment or example of the present application. In the specification, the schematic expressions to the above-mentioned terms are not necessarily referring to the same embodiment or example. Furthermore, the described particular features, structures, materials, or characteristics may be combined in any suitable manner in one or more embodiments or examples. Furthermore, those skilled in the art may combine different embodiments or examples and features in different embodiments or examples described in the specification, without mutual contradictions.

Although embodiments of the present application have been shown and illustrated, it shall be understood by those skilled in the art that various changes, modifications, alternatives and variants without departing from the principle and idea of the present application are acceptable. The scope of the present application is defined by the claims and its equivalents.

What is claimed is:

1. An air duct component for a cross-flow impeller comprising:

a first volute member, an inner end of the first volute member including a volute tongue; and a second volute member;

wherein:

the first volute member and the second volute member are arranged opposite to each other in a cross section perpendicular to an axis of the cross-flow impeller;

a cross-flow air duct formed between the first volute member and the second volute member includes a middle air duct section and an end air duct section arranged along an axial direction of the cross-flow impeller, the end air duct section being located at an end of the middle air duct section;

the middle air duct section includes a middle air outlet duct located downstream of a vertical line that passes through the volute tongue and is perpendicular to the second volute member;

the end air duct section includes an end air outlet duct located downstream of the vertical line; and an area of a cross-section of the middle air outlet duct perpendicular to the axial direction of the cross-flow impeller is larger than an area of a cross-section of the end air outlet duct perpendicular to the axial direction of the cross-flow impeller.

2. The air duct component according to claim 1, wherein a length W1 of the cross-flow air duct in the axial direction of the cross-flow impeller and a length W2 of the end air duct section in the axial direction of the cross-flow impeller satisfies 5 mm≤W2≤0.3W1.

3. The air duct component according to claim 1, wherein:

the volute tongue includes:

a middle volute tongue section corresponding to the middle air duct section; and an end volute tongue section corresponding to the end air duct section; and a minimum gap T1 between the middle volute tongue section and the cross-flow impeller is smaller than a minimum gap T2 between the end volute tongue section and the cross-flow impeller.

4. The air duct component according to claim 3, wherein T1, T2, and a diameter D of the cross-flow impeller satisfy 0.04D≤T1≤0.06D and 0.04D≤T2≤0.06D.

5. The air duct component according to claim 1, wherein in the cross section perpendicular to the axis of the cross-flow impeller, a length H of the vertical line and a diameter D of the cross-flow impeller satisfy 0.45D≤H≤0.65D.

6. An air conditioning apparatus comprising:

an air duct component including a first volute member and a second volute member forming a cross-flow air duct; and a cross-flow impeller arranged in the cross-flow air duct; wherein:

the first volute member and the second volute member are arranged opposite to each other in a cross section perpendicular to an axis of the cross-flow impeller;

the cross-flow air duct includes a middle air duct section and an end air duct section arranged along an axial direction of the cross-flow impeller, the end air duct section being located at an end of the middle air duct section;

an inner end of the first volute member includes a volute tongue;

the middle air duct section includes a middle air outlet duct located downstream of a vertical line that passes through the volute tongue and is perpendicular to the second volute member;

the end air duct section includes an end air outlet duct located downstream of the vertical line; and an area of a cross-section of the middle air outlet duct perpendicular to the axial direction of the cross-flow impeller is larger than an area of a cross-section of the end air outlet duct perpendicular to the axial direction of the cross-flow impeller.

7. The air conditioning apparatus according to claim 6, wherein:

the volute tongue includes:

a middle volute tongue section corresponding to the middle air duct section; and an end volute tongue section corresponding to the end air duct section; and a minimum gap T1 between the middle volute tongue section and the cross-flow impeller is smaller than a minimum gap T2 between the end volute tongue section and the cross-flow impeller.

* * * * *